US008457324B2

(12) United States Patent
Tice

(10) Patent No.: US 8,457,324 B2
(45) Date of Patent: Jun. 4, 2013

(54) DIRECTIONAL SPEAKER SYSTEM

(75) Inventor: Lee D. Tice, Bartlett, IL (US)

(73) Assignee: Honeywell International Inc., Morristown, NJ (US)

( * ) Notice: Subject to any disclaimer, the term of this patent is extended or adjusted under 35 U.S.C. 154(b) by 1716 days.

(21) Appl. No.: 11/204,956

(22) Filed: Aug. 16, 2005

(65) Prior Publication Data

US 2007/0041590 A1 Feb. 22, 2007

(51) Int. Cl.
*G10K 11/16* (2006.01)

(52) U.S. Cl.
USPC ..... 381/71.7; 381/71.1; 381/77; 381/82

(58) Field of Classification Search
USPC ..... 381/66, 77–82, 71.5, 71.1–71.6
See application file for complete search history.

(56) References Cited

U.S. PATENT DOCUMENTS

| | | | | |
|---|---|---|---|---|
| 3,690,405 | A * | 9/1972 | Hance | 181/155 |
| 5,073,945 | A * | 12/1991 | Kageyama et al. | 381/89 |
| 5,109,416 | A * | 4/1992 | Croft | 381/304 |
| 5,654,690 | A * | 8/1997 | Ishikawa et al. | 340/506 |
| 5,795,287 | A * | 8/1998 | Ball et al. | 600/25 |
| 6,259,796 | B1 * | 7/2001 | Lin | 381/371 |
| 6,580,803 | B1 * | 6/2003 | Peng | 381/412 |
| 6,580,809 | B2 * | 6/2003 | Stach et al. | 382/100 |
| 6,795,557 | B1 * | 9/2004 | Makivirta et al. | 381/66 |
| 7,103,193 | B2 * | 9/2006 | Croft, III | 381/345 |
| 7,561,706 | B2 * | 7/2009 | Holmi et al. | 381/306 |
| 2001/0012371 | A1 * | 8/2001 | Baumhauer et al. | 381/345 |
| 2005/0059153 | A1 * | 3/2005 | George et al. | 435/446 |
| 2005/0069153 | A1 * | 3/2005 | Hall et al. | 381/103 |

OTHER PUBLICATIONS

PCT International Search Report—Int'l App. No. PCT/US06/31246; Feb. 22, 2007 (2 pages).

PCT Written Opinion of the International Searching Authority—Int'l App. No. PCT/US06/31246; Feb. 22, 2007 (6 pages).

* cited by examiner

*Primary Examiner* — Disler Paul
(74) *Attorney, Agent, or Firm* — Husch Blackwell LLP

(57) ABSTRACT

A directional sounder emits audible outputs in a first direction. Audible outputs in a second direction are canceled. Two transducers can be carried in a common housing configured to emit outputs in the first and second directions respectively.

36 Claims, 4 Drawing Sheets

NOTE 1: THE SECOND AUDIBLE SIGNALS ARE 180 DEGREES OUT OF PHASE WITH FIRST AUDIBLE SIGNALS SO THEY EFFECTIVELY CANCEL WHEN THE AMPLITUDE OF THE SECOND AUDIBLE SIGNALS IS ADJUSTED (OR PREDETERMINED IN THE DESIGN OF THE HOUSING OR SPEAKER).

NOTE 2: THE FIRST AND SECOND OPENINGS MAY HAVE DETAILS TO FOCUS AUDIBLE SIGNALS.

NOTE 1: THE SECOND AUDIBLE SIGNALS ARE 180 DEGREES OUT OF PHASE WITH FIRST AUDIBLE SIGNALS SO THEY EFFECTIVELY CANCEL WHEN THE AMPLITUDE OF THE SECOND AUDIBLE SIGNALS IS ADJUSTED (OR PREDETERMINED IN THE DESIGN OF THE HOUSING OR SPEAKER).

NOTE 2: THE FIRST AND SECOND OPENINGS MAY HAVE DETAILS TO FOCUS AUDIBLE SIGNALS.

SPEAKER SA PRODUCES SOUND WAVES A GOING FORWARD (DESIRED) AND A' GOING BACKWARDS (NOT DESIRED). SPEAKER SB PRODUCES SOUND WAVE B GOING BACKWARDS TO CANCEL A' IN THE HALLWAY

DIRECTIONAL SPEAKER SYSTEM

FIELD

The invention pertains to sounders of a type used in alarm systems. More particularly, the invention pertains to sounders which emit highly directional audible outputs.

BACKGROUND

There are many speaker products that have been installed in alarm systems to warn occupants in a region of a life safety threat. This can include fire or other safety threats. The speaker can be used to annunciate a sound to indicate evacuation or to provide voice instructions to the occupants.

However, it can become important for occupants to quickly identify their egress path to evacuate the building. Known speaker systems mount on walls or ceilings and often do not provide any directional indications. In addition, speaker systems using voice must coordinate the different speakers to prevent distortion due to sounds from different speakers being heard at the same time. Even if the message is the same, the phase delays in sound propagation from one speaker location to another speaker location can be substantial thereby causing distortion for the occupant. This can be an important issue during stressful situations.

In one known technology speaker systems use a multi-frequency sounder with sound similar to white noise and occupants are more able to identify that speaker's location to egress towards it. The occupant can easily distinguish its direction even with sound reflections. However, a long hallway may require multiple sounders. In this circumstance, the occupant doesn't know which sounder to egress towards. The use of fire doors can be an expensive approach to overcome this problem wherein the fire doors control the sound propagation in the hallways.

It would be desirable to provide directional speakers such that an occupant in a hallway will always hear the loudest sounds to guide him/her in egressing from the building, even with multiple speakers. A fast escape maybe necessary to preserve life since hazardous gases (carbon monoxide for example) may be present in addition to smoke.

DETAILED DESCRIPTION

Figure 1A:
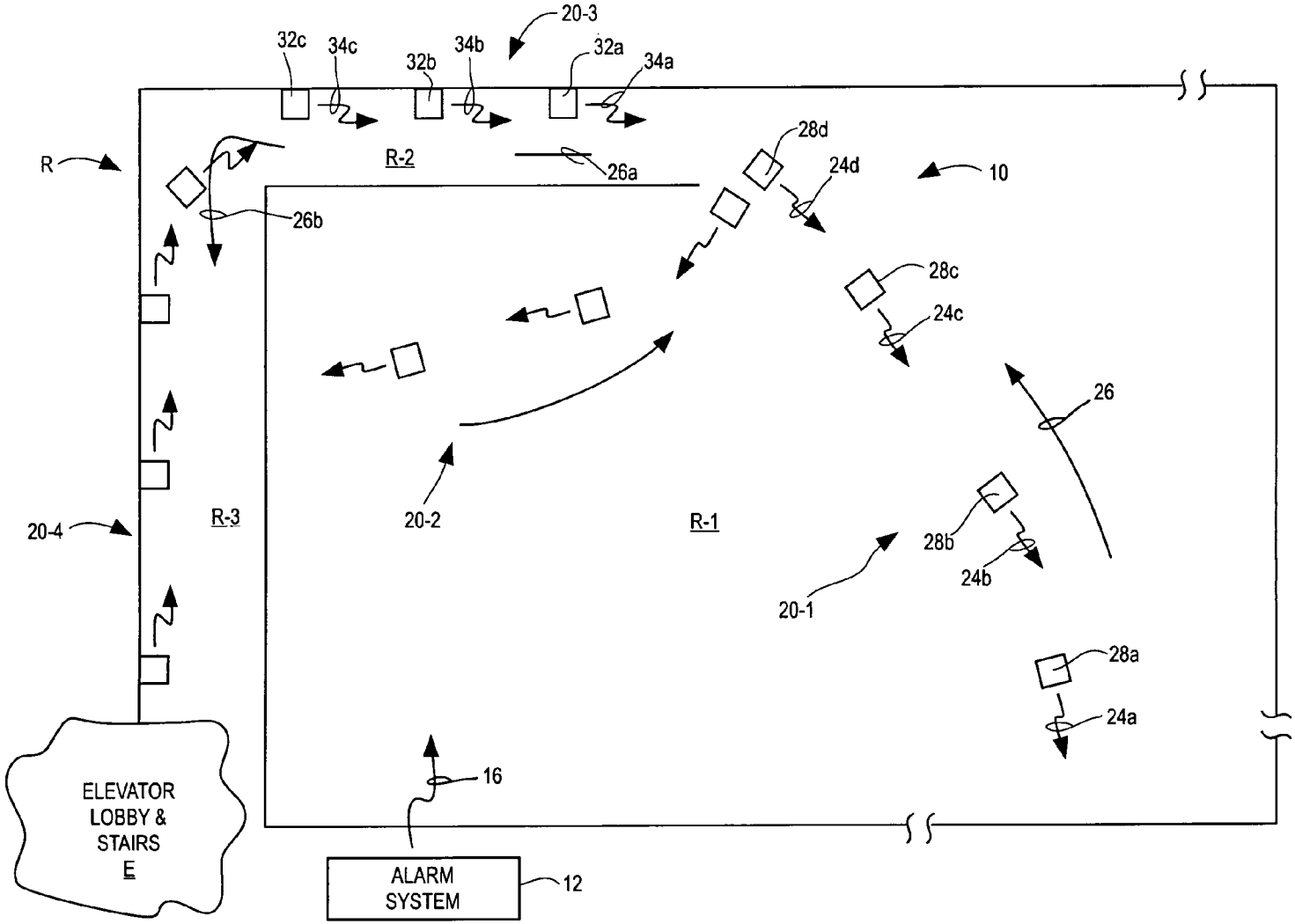
FIG. 1A is a top plan view of a system in accordance with the invention installed in a region.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Embodiments of the invention introduce sound canceling into sounders of a type used in alarm systems. Two back-to-back speakers can be incorporated into a housing wherein the speakers face opposite directions. Both speakers are substantially identical so that the same primary audibility can be achieved in either direction. Each speaker may have housing details that direct the sound forward of that speaker in as narrow a pattern as possible.

One speaker provides the signal that will be heard by the person in providing the direction of egress. The second speaker provides signal canceling for directions away from the egress.

The speakers are designed to primarily drive sound forward and less sound backwards from the housing. The second speaker's sound is 180 degrees out of phase and adjusted in amplitude to cancel undesired sound from the first speaker. It is possible that the phase could be adjusted slightly for some applications. This can be repeated for each speaker direction.

The sound canceling can be adjusted at the site by use of a remote control or other adjustment. The person making the adjustment stands in the "backward" direction of the speaker and adjusts the signal canceling speaker level such that it effectively reduces that signal to a low level relative to the "forward" direction of the speaker. This can be done for each direction.

Multiple speakers can be used in a hallway to provide a dominant directional guide toward the direction of egress with less confusion for the person. Embodiments of the invention do not rely upon sound barriers such as fire doors being implemented in order to have directional information from multiple speakers.

In accordance with an aspect of the invention, a directional speaker system includes speaker units that may contain either one or two speakers. Two sounds coming out of the speaker unit are configured such that the first sound is used for notification for the occupant and the second sound is used to cancel at least some of the first sound in certain regions of a hallway. Hence, the sound waves in one direction from the speaker are cancelled while the sound waves in the other direction are not cancelled.

The cancellation of sound waves in one direction or region can be accomplished by the second sound being essentially 180 degrees out of phase with the first sound and being a lower amplitude than the first sound. The first sound exits the speaker unit in one direction with the intent of the occupants to hear it and guide them to the exit. That sound however will propagate in the opposite direction also but with a lower amplitude, especially if the speaker unit is designed to focus most the first sound. However, even though the first sound traveling in the opposite direction is lower in amplitude (less loud), it is still loud enough to cause confusion in exiting.

The second sound is then directed in the opposite direction of the primary first sound and is used to null or cancel unwanted portions of the first sound. The net result is that the first sound traveling in the opposite direction is further reduced in amplitude such that it is now very low relative to the primary first sounds of each speaker unit which may be installed in a hallway. The occupant can be expected to follow the loudest sound in exiting from the region or building.

Known multi-frequency sounders can be incorporated to provide a further improved system to guide occupants out of a building in the fastest time.

In one aspect of the invention at least two openings are formed in a housing of the speaker unit. The first opening is to emit the primary sound, first sound. This sound will propagate outward in the direction away from the unit. However, some of that sound will also propagate back in the opposite direction although of a lower amplitude.

A second opening can then used to control the amount of second sound or amplitude of the second sound used to cancel the first sound going in the opposite direction. The control or adjustment in the second sound amplitude can be effected through the size or shape of the second opening.

In another aspect, the second opening can be a plurality of openings that are each controlled but are still serving the same purpose as a single opening. Multiple openings are alternative structures that serve the same purpose.

In one embodiment, a single speaker can be used inside a speaker unit. In this case, the sounds generated from the single speaker diaphragm moving are used for both first and second sounds. The region in front of the speaker is used to generate the first sound. The region in back of the speaker is used to generate the second sound which will be 180 degrees out of phase.

The single speaker is mounted between the first opening and the second opening with housing details to focus the first sound and to focus the second sound. The second opening can be either pre-designed to have predetermined shapes and sizes or it can be field adjusted in the application by moveable or adjustable mechanical aspects that can alter the sound level coming out.

In a second embodiment, dual speakers can be used. One speaker projects sound out the first opening and a second speaker projects sound out the second opening. A controller can contain circuitry to drive the speakers and to drive the second speaker with a 180 degree phase shift and variable amplitude.

The controller may receive signals from an external device, external device to control the second speaker. The external drive may be from a wireless remote, wired remote, or other external location with a medium to send signals to the speaker unit.

An installer can use a remote control unit by first standing in the region where it is preferred to cancel the first sounds and then adjusting the second speaker until its second sounds arriving at the installer's location are the same amplitude as the first sound. They will then cancel since they are 180 degrees out of phase. The sound level control information is then stored in the speaker unit controller.

This process of adjusting the speaker unit using two speakers can then be reversed where the speakers are of the same type and design. Then the second sound becomes the primary direction indicating sound while the first sound is used to cancel the second sound in the opposite direction.

The installer ends up determining the information that is to be stored in the speaker system for operation in either direction. The principles of operation are the same regardless of the direction selected for the speaker unit. This then results in a selectable speaker direction controlled by an external device or portion of the system. In this case, if the egress path can change due to blocked exits, then the system can reverse the speaker direction to guide the occupant in the opposite direction. The system can select which speaker unit to operate to provide the selection of sound direction so as to specify egress direction.

Figure 1B:
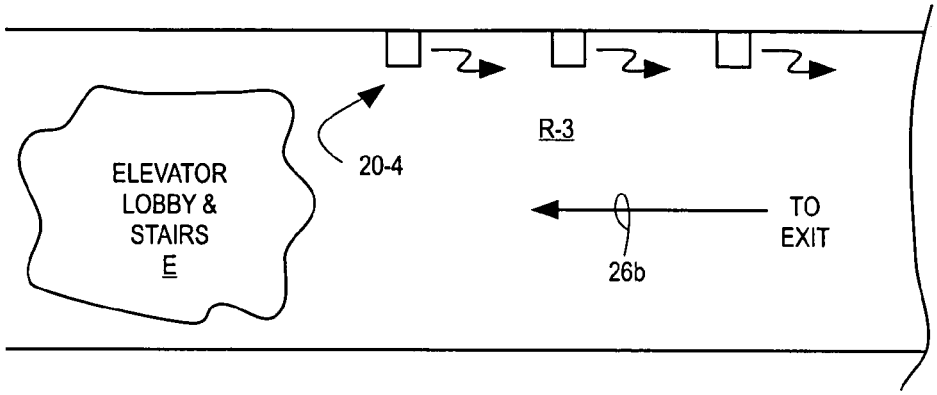
FIG. 1B is a side-elevational view of a portion of the region of FIG. 1A.

FIGS. 1A and 1B illustrate various aspects of the system 10 in accordance with the present invention installed in an exemplary region R. The region R, illustrated in FIG. 1A in a top plan view, has an open area, of the type that might be found in various offices R-1 and, a corridor having two segments R-2 and R-3 of the type typically found in office buildings which leads to, in multi-story buildings, an elevator lobby and stairs E.

Those with skill in the art will understand that the exact configuration of the region in which the system 10 is installed is not a limitation of the present invention. Further, the system 10 could be installed, if desired, in a single or a multiple family dwelling or, in a building with a single floor.

System 10 incorporates an alarm system 12 of a conventional type which is intended to monitor the region R for various conditions which can include, without limitation, fire, gas, heating, air-conditioning, as well as intrusions into the region R all without limitation. The system 10 is in a communication, either in a directional or bi-directional as desired, via a wired or wireless medium 16 with plurality of displaced sensors or detectors as would be understood by those of skill in the art. One exemplary system has been disclosed in Tice U.S. Pat. No. 4,916,432 assigned to the Assignee hereof and incorporated herein by reference.

System 10 also incorporates one or more pluralities of directional sounders such as plurality 20-1, 20-2, 20-3, and 20-4. The members of the various pluralities 20-1, -2, -3 and -4 provide highly directional audible emissions which could be verbal, to provide feed back and information to individuals in various of the sub-regions such as R-1, -2 and -3 to assist those individuals in departing the respective region as quickly and safely as possible in the event that alarm system 12 has determined that a dangerous condition is developing or has developed somewhere in the region R.

Embodiments of the invention, including the embodiment of system 10, provide highly directional audible sources to which individuals in the region R can move toward for purposes of exiting the region. Once past a particular source, as described below audible emissions from that source, which are being substantially canceled, markedly diminish.

The members of plurality 20-1, for example, emit highly directional audible outputs 24*a*, 24*b*, 24*c* and 24*d*. An individual wishing to exit the region in the vicinity of the plurality 20-1 need only move in a direction, generally indicated at 26 toward the highly directional exit indicating audible sources to proceed toward the elevator lobby and stairs E.

In accordance with the invention, the members of the plurality 20-1, namely, 28*a, b, c* and *d*, as described below, each direct desired audible outputs 24*a, b, c, d* in a first direction and cancel such outputs in a second or opposite direction. This in turn makes it possible for an individual for example moving in direction 26 to readily move between audible output devices 28*a . . . d* into the corridor region R-2. Once in the region R-2 members of the plurality 20-3, such as 32-*a . . . c* emit respective directional outputs 34*a, b, c* which assist and guide an individual wishing to exit the region R in a direction 26*a* toward the elevator lobby and stairs E. Similar comments apply to members of a plurality 20-4 in the hallway R-3.

Figure 2:
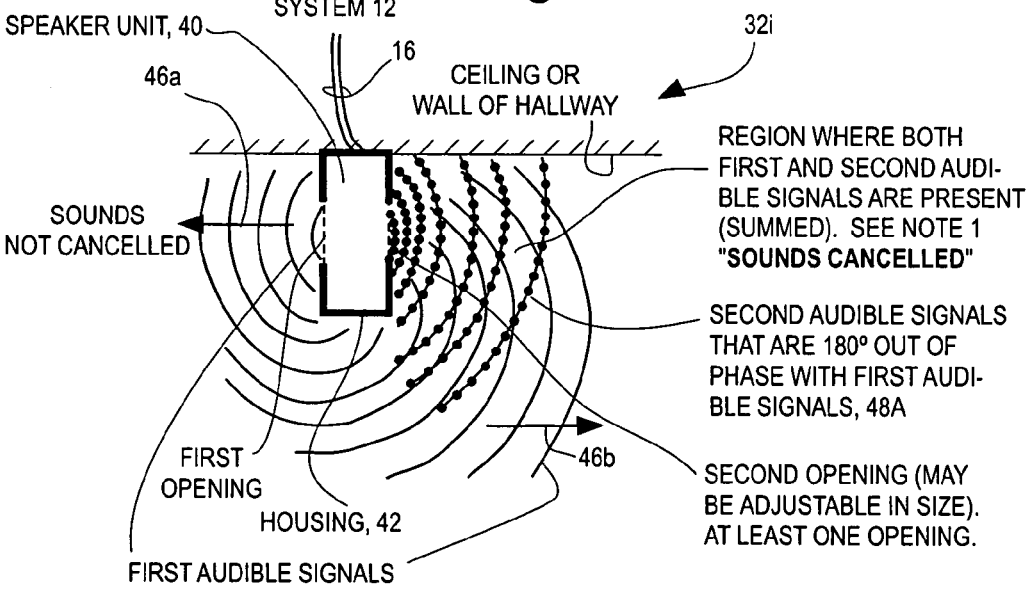
FIG. 2 illustrates operational aspects of a sounder in accordance with the invention.

FIG. 2 illustrates a representative audible output device, such as device 32*i*. Device 32*i* is coupled to system 12 via wired medium (which could also be wireless) 16. The output device 32*i* incorporates at least one audible output transducer, for example, a loud speaker, in a speaker unit 40.

Speaker unit 40 is contained in a housing 42. Housing 42 can be mounted to a ceiling or a wall of the hallway, such as in regions R-2, R-3 or in open area such as in R-1 in the event that the units are to be used therein.

The unit 32*i* emits audible outputs in a first direction 46*a* and opposite the first direction, 46*b*. The direction 46*a* corresponds to a desired output direction for primary, or, audible outputs such as 24*a . . . d*, or, 34*a, b, c*. In this regard, it is desirable to cancel to the greatest extent possible any of the primary audible emissions which may be emitted in the direction 46*b*.

In one embodiment of the invention, supplemental, canceling, audible outputs 48*a* can be emitted from speaker unit 40 in the direction 46*b*. The supplemental audible signals 48*a*, if the inverse of, or, 180 degrees out-of-phase from the primary signals emitted in a direction 46*a* will tend to cancel any of the primary audible output signals which are emitted in the direction 46*b*. Thus, audible output emitted in the direction 46*a* can be used to draw individuals who seek to exit the region toward the unit 32*i* and from unit to unit along exit paths such as 26, 26*a*, or 26*b*.

Figure 3:
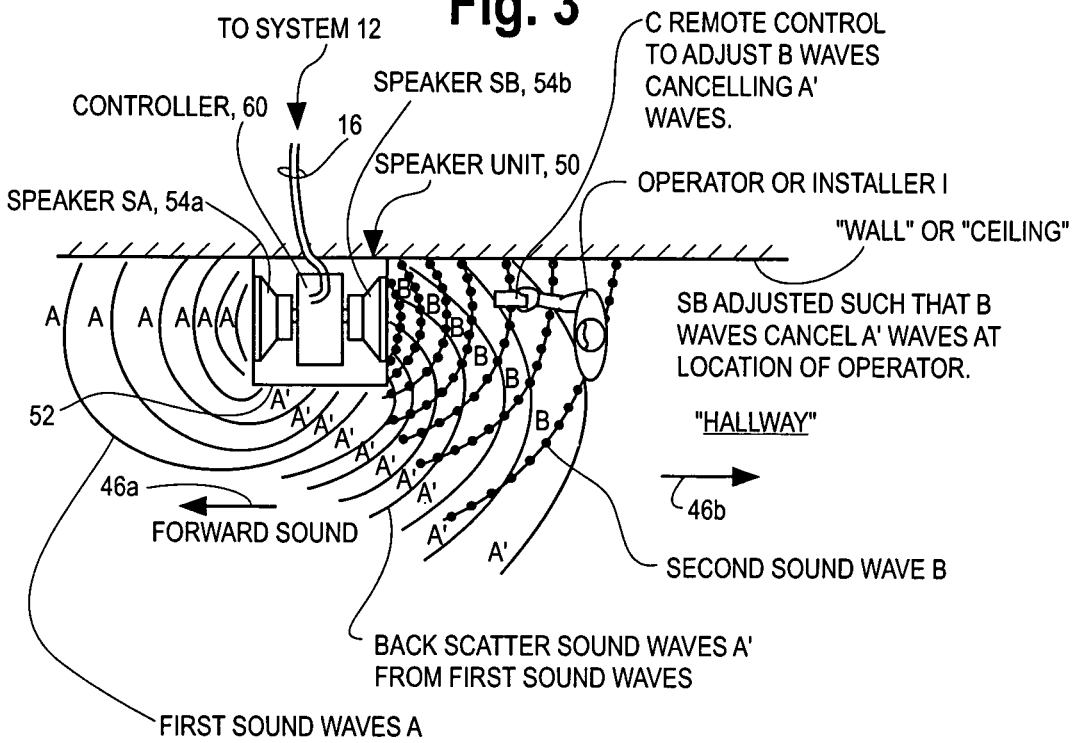
FIG. 3 illustrates an embodiment of the sounder of FIG. 2.

FIG. 3 illustrates an exemplary directional audible output unit 50 in accordance with the invention. The unit 50 includes a housing 52 which carries first and second speakers 54*a* and 54*b* which are configured to emit their primary audible outputs in directions opposite to another.

Hence, transducer 54*a* emits audible outputs in a direction corresponding to the direction 46*a*. As noted previously, speaker 54*a* may emit some portion of this audio output in the opposite direction, 46*b*. The second speaker 54*b* can be used to cancel this undesirable audible output. The speakers 54*a, b* can be driven by controller 60. The controller 60 can couple signals 180 degrees out-of-phase to one another to transducer 54*a* and transducer 54*b* thereby substantially eliminating audio output in the direction 46*b*.

As described above an operator or installer I can carry out an adjusting process using a remote, wireless control unit C. Unit C can be used to interact with controller 60 and adjust audible outputs from transducers 54*a, b*. An optimal suppression of audible outputs in direction 46*b*, direction of travel toward the elevational stairs E, can be achieved in the physical context in which the unit 50 is installed. Each member of the pluralities 20-1, -2, -3 and -4 can be optimally adjusted.

It will be understood that the form of wired, wireless communications between unit C and respective sounders is not a limitation of the invention. Wired, optical, ultrasonic or RF communications all come within the spirit and scope of the invention.

Figure 3A:
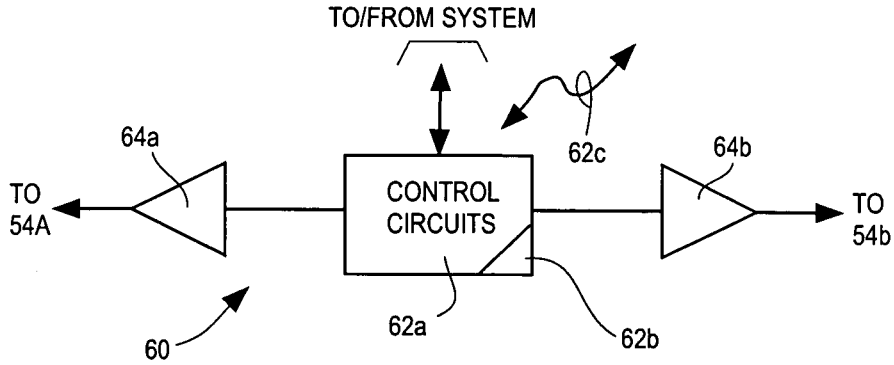
FIG. 3A is a block diagram of exemplary circuitry usable with the sounder of FIG. 3.

FIG. 3A illustrates exemplary controller 60 which incorporates control circuitry 62*a*, which could be a digital and/or analog or both, and output amplifiers 64*a* and 64*b*. Using any one of a variety of techniques as would be understood by those of skill in the art, driving signals supplied by amplifier 64 to transducer 54*a* can be out of phase or the inverse of driving signals supplied by amplifier 64*b* to transducer 54*b*. It will also be understood that the gain of the amplifiers 64*a, b* could be adjusted so as to take into account the fact that signals in the direction 26*b* from transducer 54*a* for example, are emitted with less volume and intensity than are signals emitted in primary direction 46*a* from the transducer 54*a*.

Unit 60 could include a programmable processor in control circuits 62*a*, and, software 62*b* for implementing some or all of the above functions as well as controlling communications with installer I. Medium 62*c* could be wired or wireless as discussed above.

Figure 4:
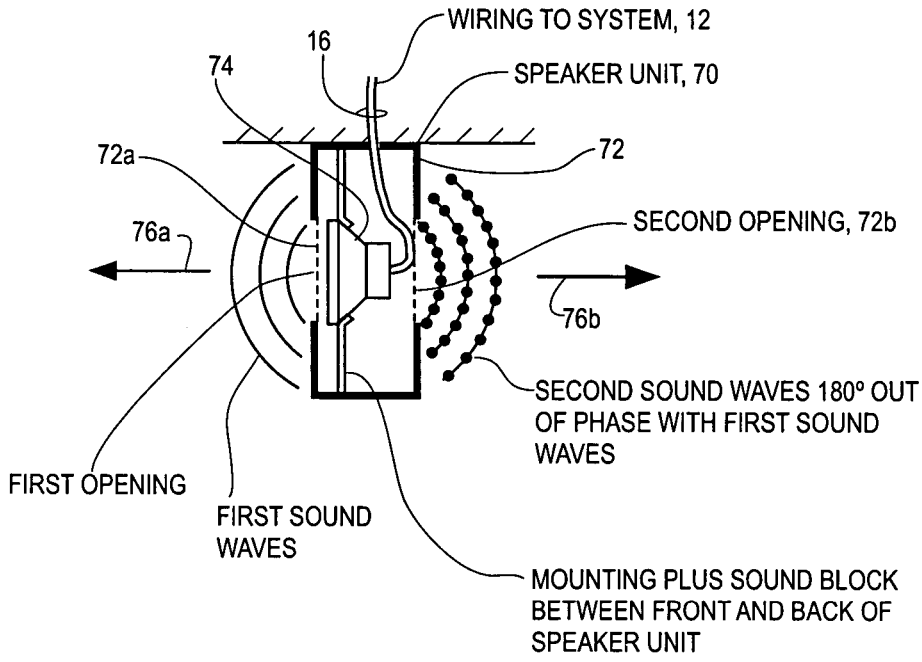
FIG. 4 illustrates another embodiment of the sounder of FIG. 2.

FIG. 4 illustrates another embodiment 70 in accordance with the present invention. The unit 70 incorporates a housing 72 and a single audible output transducer 74. The transducer 74 emits primary audible output in a direction 76*a* and secondary audible output in a direction 76*b* opposite thereto.

It will be understood by those of skill in the art that the secondary audible output from the transducer 74 can be canceled so as to provide a singular audible output in the direction 76*a* from the unit 70. As noted above, such cancellation can be achieved by the generation of audio from the transducer 74 which is used to emit the canceling audio output, which is out-of-phase with the primary audio output.

The housing 72 can incorporate first and second output ports 72*a, b* which are adjustable for the purpose of effecting the desired cancellation in the direction 76*b*. Internal buffering can be provided to effect cancellation in direction 76*b* (direction of egress).

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. An apparatus comprising:

a plurality of directional audible output devices where at least some of the output devices emit a desired first audible output directly from each of the at least some output devices primarily in a first direction and those output devices emit a second audible output directly from each respective output device in a second direction, at least a portion of the first audible output propagating in the second direction, the first direction is opposite the second direction, wherein each of the at least some output devices further comprises structure or circuitry that adjustably alters an amplitude of a sound level of the second audible output, and wherein the first audible output and altered second audible output propagating in the second direction directly from the audible output device effectively cancel one another.

2. An apparatus as in claim 1 where the at least some of the output devices each include first and second audible output transducers.

3. An apparatus as in claim 2 where at least some of the first and second transducers receive out of phase driving electrical signals.

4. An apparatus as in claim 2 where members of the plurality are each carried by a separate housing.

5. An apparatus as in claim 4 where the housings support two transducers so as to emit the desired audible output in the first direction and cancel audible outputs emitted in the opposite direction.

6. An apparatus as in claim 5 which includes control circuitry coupled to the transducers.

7. An apparatus as in claim 6 where the control circuitry emits a first electrical signal, coupled to the first transducer, and a second electrical signal, the inverse of the first signal, coupled to the second transducer.

8. An apparatus as in claim 1 where selected members of the plurality include at least a first audible output transducer.

9. An apparatus as in claim 8 where the selected members are each configured to emit desired audible output in the first direction and to cancel audible output emitted in the second direction.

10. An apparatus as in claim 1 where at least some of the devices each include a housing where the housings each include first and second ends with a first opening in the first end and a second opening in the second end with desired output emitted from the first end.

11. An apparatus as in claim 10 where at least some of the second openings are adjustable to contribute to canceling audible outputs in the second direction.

12. An apparatus as in claim 11 where the second openings are adjustable by changing one of a size or shape parameter thereof.

13. An apparatus as in claim 12 where the desired audible outputs comprise human perceptible speech.

14. An audible system comprising:

at least a first speaker and a second speaker, the speakers are adjacent to one another in a back-to-back configuration; and structure or circuitry that adjustably alters an amplitude of a sound level of an audible signal from the second speaker, where the first speaker emits a peak audible signal that propagates directly from the first speaker primarily in a first direction, at least a portion of the peak audible signal emitted by the first speaker propagates in a second direction, the first direction is opposite the second direction, where the second speaker emits an altered audible signal that propagates directly from the second speaker in the second direction, the altered audible signal emitted from the second speaker is substantially one hundred eighty degrees out-of-phase with the audible signal emitted by the first speaker, the audible signals emitted directly from the first and second speakers propagating directly from the first and second speakers in the second direction effectively cancel one another.

15. A system as in claim 14 wherein an intensity of the audible signal from the second speaker is adjusted to cancel a portion of the audible signal from the first speaker.

16. A system as in claim 15 where the audible signal from at least the second speaker is remotely adjustable.

17. A system as in claim 14 where the first and second speakers are at least in part enclosed within a common housing.

18. A system as in claim 14 where the first and second speakers receive input signals from a common controller.

19. A system as in claim 18 where the common controller receives electrical signals from a remote location.

20. A system as in claim 19 where at least some of the electrical signals are digital.

21. A system as in claim 14 where the intensity of the audible signal from the first speaker is adjustable using a remote device.

22. A system as in claim 21 where the remote device is handheld.

23. A system as in claim 14 where the audible signal from the first speaker contains voice information.

24. A system as in claim 14 where the audible signal from the first speaker includes a broad spectrum of audio frequencies.

25. A system as in claim 14 where the audible signal from the first speaker includes a varying audible frequency signal.

26. A system as in claim 14 where the audible signal from the first speaker includes a single frequency or tone.

27. A directional speaker system comprising:

a first speaker to produce first audible signals that propagates directly from the first speaker primarily in a first direction with at least a first amplitude and propagating directly from the first speaker in a second direction with at least a second amplitude, the first direction being opposite the second direction;

a second speaker to produce second audible signals that propagates directly from the second speaker in the second direction, where the second audible signals are substantially one hundred eighty degrees out of phase with the first audible signals;

a structure or circuitry that adjustably alters an amplitude of a sound level of the second audible signals, and, where the altered second audible signals propagating directly from the second speaker in the second direction sum with the first audible signals propagating directly from the first speaker in the second direction to effectively cancel one another.

28. A directional speaker system as in claim 27 where the first audible signal provides egress information.

29. A directional speaker system as in claim 28 where the egress information assists a person to egress toward the loudest audible signal.

30. A directional speaker system as in claim 28 where the egress information includes voice information.

31. A directional speaker system as in claim 27 where the first audible signal includes multiple frequencies.

32. A directional speaker system comprising:

a housing with at least a first opening at one end and at least a second opening at a second end;

at least one speaker mounted within the housing between the first opening and the second opening wherein a region in front of the at least one speaker generates first sound waves in response to movement of a diaphragm of the at least one speaker and a region in back of the speaker generates second sound waves that are 180 degrees out of phase with the first sound waves in response to the diaphram's movement such that first sound waves generated from the speaker, are primarily directed through the first opening outwards from the housing and propagate directly from the housing in a first direction and second sound waves generated from the speaker, are directed through the second opening outwards from the housing and propagate directly from the housing in a second direction, the second direction being opposite the first direction, where the at least second opening is adjustable such that the second sound waves directed through the second opening of the housing and propagating directly from the housing in the second direction are adjusted in amplitude to effectively cancel any portion of the first sound waves traveling directly from the housing in the second direction.

33. A directional speaker system as in claim 32 where the second sound waves are substantially one hundred eighty degrees out-of-phase with the first sound waves.

34. A directional speaker system as in claim 32 where the second opening is adjustable by changing the size of the second opening.

35. A directional speaker system as in claim 32 where the second opening comprises multiple openings adjusted by closing off at least in part, at least one of the second openings.

36. A directional speaker system as in claim 32 where the first audible signal includes multiple frequencies.

* * * * *